United States Patent [19]

Barnby

[11] 4,101,131

[45] Jul. 18, 1978

[54] COMPETITIVE GAME APPARATUS

[76] Inventor: Donald W. Barnby, 1111 Army Navy Dr., Apt. C 1004, Arlington, Va. 22202

[21] Appl. No.: 711,226

[22] Filed: Aug. 3, 1976

[51] Int. Cl.[2] ..... A63F 9/14

[52] U.S. Cl. ..... 273/239; 273/284; 273/287; 273/290

[58] Field of Search ..... 273/130 A, 130 R, 130 G, 273/131 AB, 131 E, 134 CA, 134 CH; 35/7 A

[56] References Cited

U.S. PATENT DOCUMENTS

| | | | |
|---|---|---|---|
| 3,186,323 | 6/1965 | Niehaus | 35/7 A |
| 3,403,460 | 8/1968 | Barrows | 273/130 R |

OTHER PUBLICATIONS

"Printing-Out Paper", Focal Encyclopedia of Photography, c. 1969, Focal Press Ltd.; pp. 1173, 1175, 1176.

Product Engineering; Jan. 9, 1961; "What You Can Do With Flexible Magnets", by Annesta R. Gardner, pp. 65–68.

*Primary Examiner*—Robert W. Michell
*Assistant Examiner*—Arthur S. Rose
*Attorney, Agent, or Firm*—Witherspoon, Lane & Hargest

[57] ABSTRACT

A board game comprising a multiple layer game board the top two layers of which are separable but maintained in registration and several sets of playing pieces, each set distinguishable from the other. The top layer is transparent and has an array of playing positions marked on it. The second layer carries indicia which can be seen through the top layer and which influence the placing of playing pieces on the game board in accordance with the rules. The third layer and the playing pieces are magnetically attracted to one another thus securing the pieces placed on the game board against moving out of place. The playing pieces are stackable and a stacked piece is mechanically or magnetically secured to the piece upon which it rests. The game played in accordance with the rules described is a remarkable simulation of auto racing and closely duplicates the physical laws of motion and the natural effects of speed, acceleration and momentum. The separable layers of the game board provide for interchangeable race tracks to add variety to the game. In addition, flexible barriers which interact magnetically with the game board can be placed on the surface of the board for rapid design of new track configurations by the players.

6 Claims, 14 Drawing Figures

FIG. 1
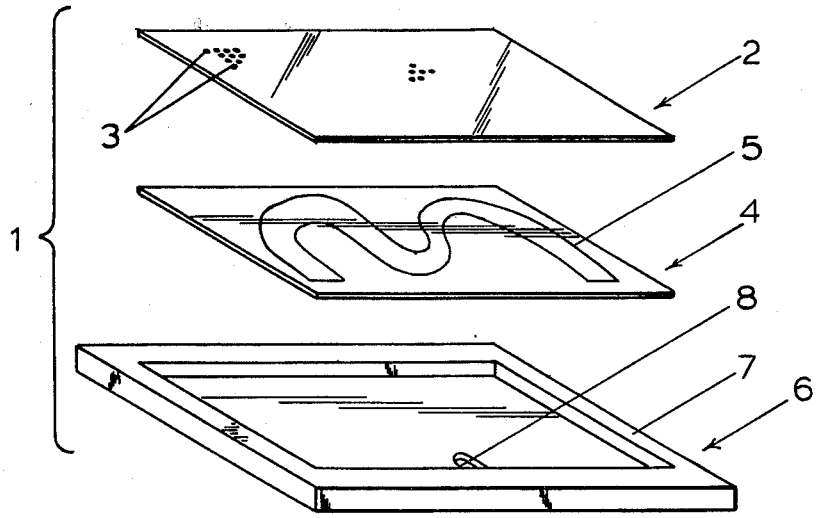
FIG 2
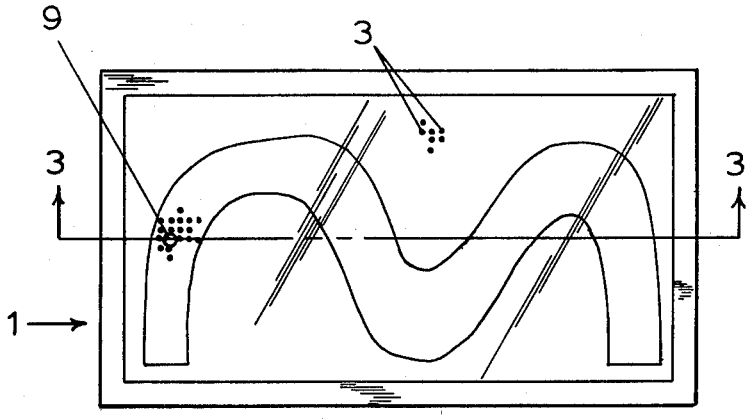
FIG. 3
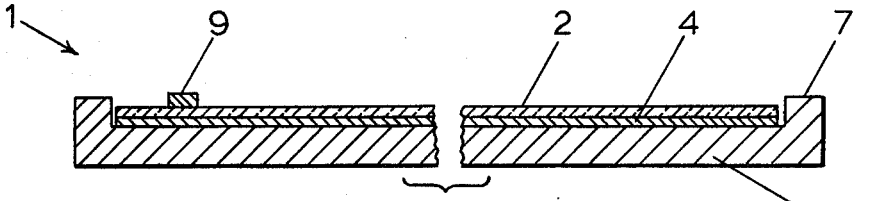
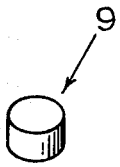
FIG. 4
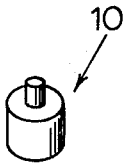
FIG. 5
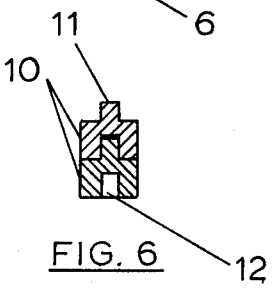
FIG. 6
FIG. 7
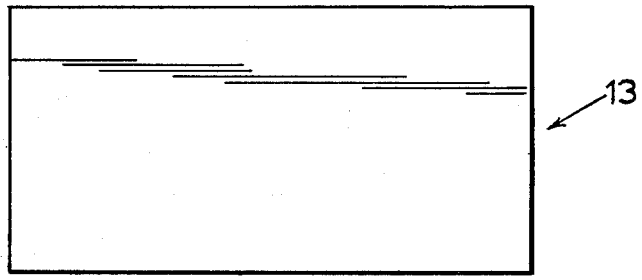

FIG. 8
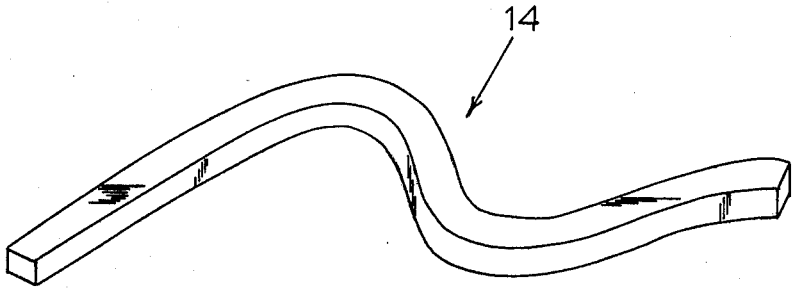
FIG. 9
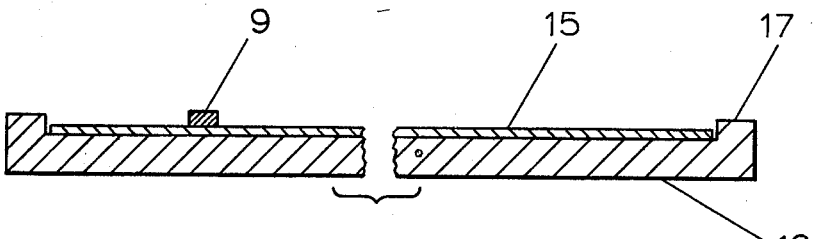
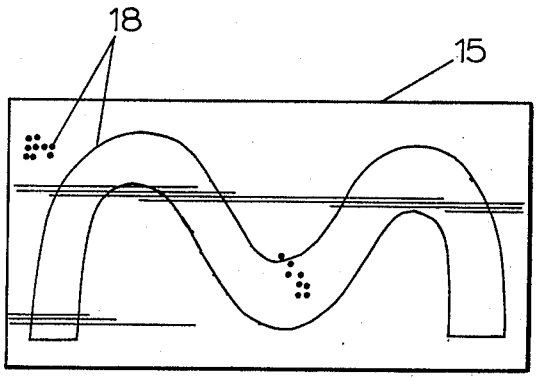
FIG. 10
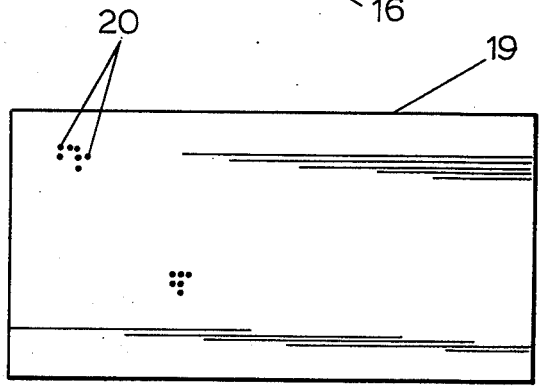
FIG. 11
FIG. 12
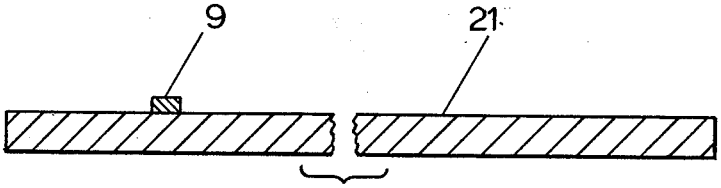
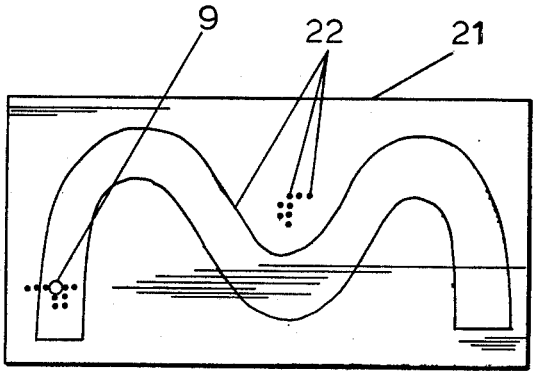
FIG. 13
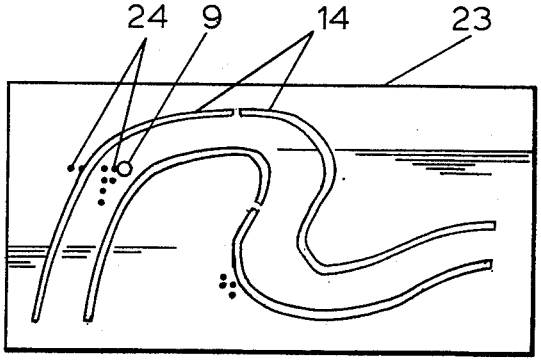
FIG. 14

COMPETITIVE GAME APPARATUS

CROSS REFERENCE TO RELATED APPLICATION

This application relates to an application also titled "Competitive Game Apparatus" filed on the same day.

BACKGROUND OF THE INVENTION

This invention relates to games, and more specifically to board games which have a playing surface and playing pieces which are deployed thereon. Many such games are designed to simulate real life action sports such as football, golf, horse racing or auto racing. In most such cases the simulation of the sport is at best superficial. Usually, the movement of the pieces is determined at least in part by some element of chance such as the throw of dice or draw of cards. Also in most such cases a given set of pieces is used and those pieces are actually moved from one location to another over the game board. Such movement of the pieces destroys any historical record of the game and makes it impossible to critique past plays as the game progresses. Furthermore, most board games provide only one configuration of playing surface such as a single race track or football field. Thus after playing the game many times it becomes somewhat routine and dull since once a good strategy is developed, then the game loses much of its challenge and any remaining challenge becomes increasingly dependent on the change element of the game.

SUMMARY OF THE INVENTION

It is an object of the present invention to provide a new and improved game.

It is also an object of the present invention to provide a new and unique game which simulates closely the motion of racing cars, or other vehicles, and the effects of acceleration, deceleration, momentum, vehicle weight and power, particualrly in a competitive racing or rallying context.

Still another object of the present invention is to provide a new and unique game wherein the advancing of the playing pieces is accomplished not by moving pieces already on the board but by placing additional pieces on the board, thereby tracing graphically the full history of the play of the game as it develops.

Yet another object of the present invention is to provide a new and unique game wherein the play of the game is not governed in any way by chance but is instead governed by the judgment and strategy of the players.

Still yet another object of the present invention is to provide a new and unique game wherein any one of a number of predetermined playing surface configurations can be easily utilized to add variety to the play of the game.

Yet still another object of the present invention is to provide a new and unique game wherein new and previously unplayed configurations of the playing surface can be easily and rapidly designed by the players prior to playing, thereby further expanding the variety of play of the game.

A further object of the present invention is to provide a new and unique game whereby its design prevents the slipping or dislodging of the playing pieces and stacks of playing pieces which are deployed on the game board.

A still further object of the present invention is to provide a new and unique game wherein the relatively costly means of securing the playing pieces on the game board need not be duplicated for every indicia configuration thereby permitting a large variety of indicia to be provided at relatively low cost.

BRIEF DESCRIPTION OF THE DRAWINGS

The invention itself is set forth in the claims appended hereto and forming a part of this specification. An understanding of some embodiments of the invention may be derived from the detailed description taken in conjunction with the following drawings in which like reference characters designate like or corresponding parts throughout the several views, and wherein:

FIG. 1 is an exploded isometric illustration of the three layer game board in accordance with this invention;

FIG. 2 is a plan view of the game board embodiment shown in FIG. 1 with a single playing piece thereon;

FIG. 3 is a cross-sectional view of the game board embodiment taken on line 3—3 in FIG. 2;

FIG. 4 is an isometric illustration of a playing piece which may be used with this invention;

FIG. 5 is an isometric view of a playing piece which may be used with this invention;

FIG. 6 is a cross-sectional view of two playing pieces, of the type shown in FIG. 5, stacked one atop the other;

FIG. 7 is a plan view of a blank second layer having no indicia;

FIG. 8 is an isometric view of a flexible barrier for use on top of the game board;

FIG. 9 is a cross-sectional view of an embodiment of a two layer game board with one playing piece on it;

FIG. 10 is a plan view of the top layer of the embodiment of FIG. 9 showing indicia which include both an array of playing positions and a race track;

FIG. 11 is a plan view of the top layer of the embodiment of FIG. 9 having indicia which are composed of only an array of playing positions;

FIG. 12 is a cross-sectional view of an embodiment of a game board with a playing piece thereon;

FIG. 13 is a plan view of FIG. 12 showing indicia which include an array of playing positions and a race track;

FIG. 14 is a plan view of a game board showing indicia composed only of an array of playing positions and having flexible barriers and one playing piece thereon.

DETAILED DESCRIPTION OF THE ILLUSTRATED EMBODIMENTS

FIG. 1 shows a game board 1 which is comprised of three layers. The top layer 2 is a flat sheet of transparent material having an array of playing positions 3, only some of which are shown, on its surface arranged in a pattern defined by the points of intersection of a square grid.

The second layer 4 is a flat sheet of material such as paper or cardboard on which is printed indicia 5 which can be seen through the transparent top layer 2 and which influences the placement of the playing pieces on the game board 1 in accordance with the rules. In this illustration the indicia 5 are in the configuration of a curving track.

The third layer 6 is generally a flat surface constructed of material which is magnetic and has an upward projecting edge 7 which encompasses the perimiter of the top layer 2 and second layer 4 when the three layers are assembled. Upward projecting edge 7 prevents lateral movement of top layer 2 and second layer 4 relative to one another. Finger hole 8 in the third layer 6 permits easy removal of the top layer 2 and second layer 4 without inverting the entire game board.

FIG. 2 is a plan view of the game board 1 of FIG. 1 and shows one playing piece 9 in position. Only a small number of the array of playing positions 3 are shown in FIG. 2.

FIG. 3 shows the assembled three layer game board 1 in cross-section along line 3—3 of FIG. 2.

FIG. 4 shows an isometric view of a cylindrical playing piece 9 which is made of magnetic material.

Either or both of the magnetic playing pieces 9 and the magnetic third layer 6 are magnetized so as to provide attraction between them which tends to secure the playing pieces to the game board and retards the lateral movement of the playing pieces relative to the game board. This securing is important since the play of the game involves the placement of many playing pieces on the board and they could otherwise be easily moved out of position if the board were bumped or tilted. Furthermore, when the playing pieces are magnetized the magnetic attraction between playing pieces which are stacked on top of one another prevents the upper playing piece from falling off of the playing piece on which it rests.

FIGS. 5 and 6 show an embodiment of playing pieces 10 which are made of magnetic material and which interact mechanically when stacked. Such mechanical means of stabilizing the stack is useful when the playing pieces are not magnetized. Each playing piece 10 has a stacking projection 11 extending from one side and a hole 12 in the opposite side. Hole 12 accepts stacking projection 11 when the playing pieces 10 are stacked one atop the other as shown in FIG. 6.

FIG. 7 shows a blank second layer 13 which contains no indicia. One or more of such blank second layers can be provided for the purpose of allowing the players to draw indicia of their own design, thus adding considerable variety to the game. In addition, a blank layer 13 can be used as a background when flexible barriers, which will be described later, are used to form the boundaries of the race track.

In addition to providing for interchangeable indicia, there are two reasons for having a multiple layer game board. First of all it is important that the array of playing positions be supplied separately from the other indicia such as the track if players are to have the capability of drawing their own tracks on blank paper because it is not practical for the players to have to draw an array of several thousand playing position markings. Thus, a single transparent top layer bearing the playing position indicia can be utilized with any second layer bearing track indicia. Secondly, if a variety of tracks are to be provided, including the capability of drawing indicia on blank sheets, then it is important that the magnetic layer be separate from the indicia because it would be too costly to construct every indicia containing layer out of magnetic material. Thus a single magnetic layer can be utilized with any desired number of layers having indicia.

Additional flexibility and ease of designing original tracks is accomplished by providing long thin strips of flexible material which are magnetic and which can be arranged in the desired configuration on top of the game board to form boundaries of a track. FIG. 8 shows such a flexible barrier 14 which is constructed so as to interact via magnetic attraction with the magnetic portion of the game board. Such a flexible barrier might typically be made of rubber which contains powdered magnetic material such as iron within it.

FIG. 9 shows a cross-sectional view of an embodiment of a two layer game board having a top layer 15 that is essentially a flat sheet such as paper, cardboard or plastic, and a second layer 16 which has an upstanding edge 17 which engages the edge of the top layer 15 to prevent its shifting. Second layer 16 is made of magnetic material. Playing piece 9 is shown on the game board.

Either or both of the playing pieces 9 and the second layer 16 are magnetized so as to provide attraction between them which tends to secure the playing pieces to the game board and retards the lateral movement of the playing pieces relative to the game board.

FIG. 10 shows a plan view of the top layer 15 and reveals the indicia 18 thereon. In this embodiment the indicia printed on top layer 15 include both the array of playing positions, only some of which are shown, and also the track configuration.

FIG. 11 shows a plan view of an alternative top layer 19 which contains only the array of playing positions 20, only some of which are shown, on its surface. A plurality of top layers of this type can be provided to enable the players to draw their own track configurations. Also a top layer 19, having only an array of playing positions 20, can be used as a background when flexible barriers 14, as shown in FIG. 8, are used with this two layer embodiment of the game board.

FIG. 12 shows a cross-sectional view of another embodiment having a single layer game board 21 which is essentially a flat sheet made of magnetic material. A single magnetic playing piece 9 is shown on the game board.

Either or both of the playing pieces 9 and the game board 21 are magnetized so as to provide attraction between them which tends to secure the playing pieces to the board and retards the lateral movement of the playing pieces relative to the game board.

FIG. 13 is a plan view of the game board 21 with playing piece 9 and reveals indicia 22 thereon. The indicia 22 include both an array of playing positions, only some of which are shown, and also the track configuration.

FIG. 14 shows a plan view of a single layer game board 23 having printed on its surface indicia 24 which consists of only the array of playing positions. In this instance the boundaries of the track are formed by placing the magnetic flexible barriers 14, also shown in FIG. 8, on the game board. Only some of indicia 24 are shown in FIG. 14.

In the discussion of this invention the term "magnetic" or "magnetic material" is not intended to mean only a monolithic material but also refers to any composit material composed of both magnetic and non magnetic components. In other words it means that a part made of magnetic material is constructed so as to interact with a magnetic field. Furthermore such part may or may not be magnetized as otherwise indicated.

Obviously many modifications and variations of the graphic indicia on the game board and the structure of the game apparatus of the present invention are possible in the light of the above teaching.

For example, instead of a track which the playing pieces follow from start to finish, it is possible to have a branching track or for the play of the game to occur in a generally open board area, or in an open area having obstacles or goals placed within it.

An additional example would be a stacking means which, instead of using stacking holes and stacking projections, uses other configurations of mating contours such as annular grooves and projections which mate together, or mating saw-toothed contours.

It is therefore understood that within the scope of the appended claims the invention may be practiced otherwise than as specifically described herein.

RULES OF PLAY

The following description will relate to a racing competition played on a curving track. The rules described, however, can generally apply to a variety of games using different tracks or using a generally open area rather than a constrained track.

The game is one of racing strategy an maneuvering skill. It closely simulates the physical laws of motion and the natural effects of speed, acceleration and momentum. If a palyer goes into a curve too fast he will swing wide and may even crash off of the track. On the other hand, proper slowing in the turns will allow him to cut the curves closely and gain the advantage.

Two or more players may compete. Each player has a supply of playing pieces of a given color. In describing the play of the game it is convenient to refer to the perpendicular rows and columns of playing positions as the north-sourth (N-S) direction and the east-west (E-W) direction.

To start, each player, in turn, places his first piece in one of the positions in the first row beyond the startng line. Each succeeding play is made by placing an additional piece on the board. Previously played pieces remain on the board and graphically trace out the progress of the race. No piece may be placed at a position that is outside the track or which touches the edge of the track.

The placement of the pieces is governed by a speed change rule and in some cases by a speed limit. Various speed change rules are possible, however for the moment only the fundamental speed change rule will be discussed. It is as follows: "In a given turn, the number or spaces which a player may move along the N-S direction must be equal to the previous N-S distance moved or one space more or one space less. Likewise, the number of spaces which a player may move along the E-W direction must be equal to the previous E-W distance moved or one space greater or one space less." A single move is a combination of both the N-S and E-W moves, even though one of them may be zero. Thus, the speed change rule allows gradual acceleration and deceleration and eventual change of direction.

In some races the players may choose to impose speed limits. A speed limit will state a maximum distance allowed for both the N-S or E-W components of any move regardless of the options provided by the speed change rule.

At the start of the game each player's first piece is defined as having moved one space perpendicular to the starting line and zero spaces in the other direction.

No two players may occupy the same location at the same time. In other words, no collisions are permitted. This means that no player may move to a location occupied by an opponent's leading piece. It is permissable, however, to occupy an old location of another player, and that is accomplished by stacking one's piece on top of the previously played piece.

Any player who cannot avoid hitting the boundary of the track or another player's leading piece, crashes and is out of the race. The first player to cross the finish line is the winner. Since all players are allowed to complete the same number of turns, it is possible that more than one player may cross the finish line in the same number of moves. In that event, the win goes to the player whose last move takes him furthest beyond the finish line (measured perpendicular to the finish line).

Numerous speed change rules are possible and add variety and interest to the game. One alternative rule would be to allow the distance moved in each direction to differ by a maximum of two spaces from the previous move instead of one space. This corresponds to using a lighter or more powerful car having faster acceleration and deceleration.

Another alternative speed change rule is to specify that the sum of the speed changes in both directions must be no greater than a specified maximum. For example, if the specified maximum were two, then a player could change his speed by one space in each direction, or by zero spaces on one direction and two spaces in the other.

Still another alternative rule would allow a maximum speed change of say one space along one direction and two spaces along the other direction.

It is obvious that many additional variations and combinations of the fundamental speed change rule as well as other rules are possible, and it is therefore understood that within the scope of the appended claims the invention may be practiced otherwise than as specifically described herein.

What is claimed is:

1. Competitive game apparatus comprising:

a plurality of sets of playing pieces, each one of said plurality of set of playing pieces having a plurality of playing pieces which have a common characteristic which distinguishes them from the plurality of playing pieces of every other set of said plurality of sets of playing pieces;

stacking means included by at least some of said playing pieces whereby said stacking means permits one of said playing pieces to be stacked upon another and said stacking means also tends to prevent lateral movement of such stacked playing pieces relative to one another thereby tending to prevent an upper playing piece from falling off of the playing piece upon which it is stacked;

a multiple layer game board, having a top layer which is essentially a flat sheet made of transparent material, at least one second layer which is essentially a flat sheet located beneath said top layer, and a third layer which is essentially a flat surface located beneath said second layer, said top layer and said at least one second layer being separable;

a first indicia, which designates the playing positions, carried by said transparent top layer;

a second indicia carried on at least one surface of said at least one second layer, said first indicia being different from any part of said second indicia and said second indicia being visible through said transparent top layer and influencing the placing of said playing pieces on said multiple layer playing board in accordance with the rules of the game being played;

magnetic means which provides magnetic attraction between said playing pieces and said third layer.

2. Competitive game apparatus as set forth in claim 1 further comprising:

flexible barrier means which comprises long thin strip means made of flexible material, said flexible barrier means constructed so as to interact magnetically with said third layer so as to experience magnetic attraction between said flexible barrier means and said third layer.

3. Competitive game apparatus as set forth in claim 1 further comprising:

register maintaining means which prevents substantial lateral shifting of said top layer and said second layer relative to one another.

4. Competitive game apparatus as set forth in claim 1 further comprising:

at least one additional second layer having at least one side which has no indicia.

5. Competitive game apparatus as set forth in claim 1 further comprising:

a plurality of said second layers, more than one of said second layers having second indicia on at least one surface, each of said second indicia of said plurality of second layers being different and said plurality of second layers being interchangeable so that each one of said plurality of second layers may be placed beneath said top layer.

6. Competitive game apparatus as set forth in claim 1 wherein:

said stacking means comprises magnetic attraction means between said playing pieces.

* * * * *